United States Patent [19]

Descombes

[11] Patent Number: 4,763,309

[45] Date of Patent: Aug. 9, 1988

[54] PROGRAMMING ARRANGEMENT FOR A NON-VOLATILE MEMORY FOR A TIMEPIECE

[75] Inventor: Arthur Descombes, Kerzers, Switzerland

[73] Assignee: EM Microelectronic-Marin SA, Marin, Switzerland

[21] Appl. No.: 71,503

[22] Filed: Jul. 9, 1987

[30] Foreign Application Priority Data

Jul. 10, 1986 [CH] Switzerland ..... 2773/86

[51] Int. Cl.[4] ..... G04B 17/12

[52] U.S. Cl. ..... 368/201; 368/200

[58] Field of Search ..... 368/200–202

[56] References Cited

U.S. PATENT DOCUMENTS

| | | | |
|---|---|---|---|
| 3,895,486 | 7/1975 | Hammer et al. | 368/201 |
| 4,051,663 | 10/1977 | Chihara et al. | 58/26 R |
| 4,074,514 | 2/1978 | Vaucher | 58/23 |
| 4,147,022 | 4/1979 | Ichikawa | 368/201 |
| 4,290,130 | 9/1981 | Lowdenslager et al. | 368/200 |
| 4,372,689 | 2/1983 | Remy | 368/155 |
| 4,475,180 | 10/1984 | Sekiya et al. | 365/228 |

FOREIGN PATENT DOCUMENTS

| | | |
|---|---|---|
| 2283478 | 3/1976 | France . |
| 1337 | 12/1971 | Switzerland . |

*Primary Examiner*—Bernard Roskoski

*Attorney, Agent, or Firm*—Griffin, Branigan & Butler

[57] ABSTRACT

This programming arrangement for a non-volatile memory incorporated in the inner circuit of a timepiece for adjusting the frequency of the time base thereof includes a support provided with a connector to be plugged in in place of the energy cell. The rate of division of the frequency divider is adjusted by the introduction into the memory of a number k representative of the frequency difference between the time base frequency and a standard frequency. To effect this the arrangement comprises an electronic circuit external to the timepiece and which is coupled thereto by the connector. The electronic circuit introduces the number k into certain predetermined stages of the divider. When such number k is thus introduced the state of such stages is blocked by the inner circuit of the timepiece such state then being transferred into the non-volatile memory.

2 Claims, 5 Drawing Sheets

PROGRAMMING ARRANGEMENT FOR A NON-VOLATILE MEMORY FOR A TIMEPIECE

This invention concerns a programming arrangement for an electrically alterable non-volatile memory for a timepiece, said timepiece including an oscillator, a multistage frequency divider the division rate of which is adjustable by alteration of a number k of pulses furnished by a stage thereof, the number k being representative of the frequency difference between the oscillator frequency and a standard frequency and appearing in a binary form recorded in the non-volatile memory in order to modify the contents of certain predetermined stages of the divider at regular intervals, a stepping motor receiving driving pulses from the divider to display time in an analog manner and a receptacle adapted to accommodate an energy cell.

BACKGROUND OF THE INVENTION

As has been mentioned in respect of the Swiss Pat. No. 534,913 (corresponding to U.S. Pat. No. 3,895,486), the adjustment of a quartz controlled oscillator in a timepiece is particularly complicated. If the coarse adjustment is initially effected by mechanical precision machining and thereafter by fine adjustment of the encapsulated quartz, the final adjustment is effected with the aid of a trimmer which on one hand compensates the increase of spurious capacities and on the other hand permits correcting a drift of the time base when the quartz has aged. Since the consumption of the oscillator is proportional to the square of the value of the capacities of the circuit into which it is connected, it will be understood that it is necessary to reduce such capacities as much as possible from whence there is an interest to eliminate the trimmer. Such suppression also exhibits the advantage of improving the frequency stability and of eliminating the necessity of an expensive and delicate item. The cited patent proposes on one hand to eliminate certain frequency adjustment operations for the quartz and to thus reduce its manufacturing cost while improving its stability and on the other hand to remove all electronic regulating systems (trimmer) at the stage of the time base. These purposes are attained in that the divider exhibits auxiliary electrical inputs of which the logic state determines the division relationship and in that the timepiece includes a memory coupled to these auxiliary inputs in order to retain in a coded form the information determining the division ratio by acting on these auxiliary inputs.

The system which has just been suggested necessitates the employment of a certain number of switches which provide a certain number of orders of inhibition for each adjustment period. The difficulty of obtaining these switches in a miniature form tends to limit the number thereof which in turn limits the range of possible adjustment. Furthermore, the operations of adjusting the operation are complicated and require the skills of a master watchmaker. To overcome these difficulties, the Swiss Pat. No. 570,651 (corresponding to U.S. Pat. No. 3,914,706) suggests the employment of an electronic variable memory (in place of the switches) which offers the advantage of being obtainable through the same technology as the remainder of the circuits and integrated on the same chip, to no longer limit the number of bits (enlarged field of adjustment) and of being capable of modifying the state of the memory by purely electronic operations. To achieve this purpose the last cited patent comprises a learning block which compares the period of the signal furnished to the display with an external reference which following thereon calculates the correction to be effected and which finally transfers the result into the variable memory.

In order to compare the frequency of the standard signal with the frequency provided by the timepiece oscillator, the second patent cited provides an input terminal for the standard signal, this complicating the practical production of the timepiece. To overcome this difficulty, there have already been proposed systems which do not require any auxiliary input and in which the terminals of the energy cell alone are sufficient, these being normally accessible in this type of timepiece, in order to bring about the entire adjustment of the frequency divider as well as checking this adjustment if necessary. It will be readily understood the advantages of such a system for a completely sealed wrist watch which is not readily taken apart and where only the terminals of the battery are accessible. Such type of watch is currently found on today's market and is generally formed of plastic material.

The transactions of the 59th Congress of the Société Suisse de Chronométrie, held Oct. 4th and 5th, 1985, include a communication entitled: "A watch circuit with EEPROM for digital frequency adjustment" presented by Ronald Geddes. This communication already describes a programming system for a non-volatile memory for a timepiece where the entire programming and checking take place through the terminals alone of the energy cell. To this end, there is provided a programming circuit external to the watch and connected to the terminals of the battery and in which is stored initially a number k of pulses representing the difference in frequency between the frequency of the watch oscillator and a standard frequency. Thereafter, the voltage of the programming circuit is increased to 6.3 volts which has as effect to reset to zero the divider chain.

The number k of pulses is then introduced into this chain in lowering the energizing voltage to 5 volts k times. This accomplished, the contents of the chain is recorded into the non-volatile memory by maintaining during about 200 ms the energizing voltage at 5 volts.

SUMMARY OF THE INVENTION

The system which has just been described summarily necessitates a relatively complicated arrangement of the integrated circuit incorporated into the watch. It comprises in particular an entire timing sequence circuit for the control of the programming which begins when the voltage is brought to 6.3 volts. It further necessitates several different voltage level detectors. To overcome these difficulties the present invention proposes an internal circuit for the watch which is simplified and which lowers the cost and increases the reliability. In the system according to the invention, the complexity of the programming circuits above all is transferred to an external accessory which poses no problem in itself and removes from the timepiece a large number of elements or components which are employed only during programming. In order to accomplish this the means which are employed are as set forth in the claims.

The invention will now be explained in the description about to follow, given by way of example in referring to the drawings relating thereto.

DESCRIPTION OF THE PREFERRED EMBODIMENT

Figure 1:
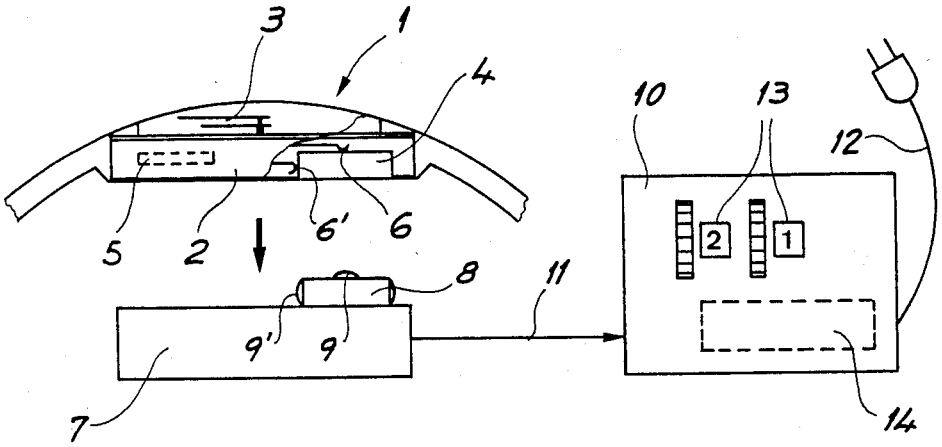
FIG. 1 is a schematic representation of the arrangement according to the invention.

FIG. 1 is a schematic representation of the arrangement used according to the invention. The timepiece 1 is here a wrist-watch including a case 2, hands 3 driven by a stepping motor (not shown) and a battery receptacle 4 normally intended to receive an energy source. The watch further includes an electronic integrated circuit 5 energized by contacts 6 and 6' ending up at the battery receptacle. When the division rate of the frequency divider contained in the circuit 5 is to be adjusted, the watch is placed on a stand 7 itself provided with a connector 8. The connector is provided with terminals 9 and 9' which come into contact with contacts 6 and 6' of the watch. The connector is coupled to a measuring and regulating apparatus 10 by a cable 11. Apparatus 10 is connected to the mains supply by cord 12.

In order to proceed with regulation of the frequency divider, initially the difference in frequency between the oscillator mounted in the watch and the frequency provided by an exact and stable standard oscillator is measured. The frequency of the internal oscillator for the watch may be measured by means of inductive or capacitive sensors which sense the advancing steps of the motor or the vibrations emitted by the quartz of the timepiece.

Generally the quartz is cut in a manner such that its frequency is higher than the standard frequency although there exist systems where the quartz frequency is maintained lower than the standard frequency. Thereafter, the frequency divider is adjusted by alteration of its division rate by a number k of pulses furnished by a divider stage. In the first case pulses will be suppressed, this leading to well known systems referred to as inhibition systems. In the second case, less usual, the missing pulses are added. All the description to follow is based on the inhibition system, but the invention could also be extended to the system of pulse additions.

Commercially available instruments enable measurement of the frequency difference. One may mention for instance the apparatus commercialized by the Société ETA SA in Granges (Switzerland) and sold under the name of QUIS. Such apparatus is capable of measuring the existing frequency spread in ppm (parts per million $=10^{-6}$) between the standard frequency and the real frequency of the quartz. If this frequency spread is x ppm, one may calculate the number k of pulses to be suppressed by periods of t seconds to a frequency f furnished by a stage of the frequency divider. This number k is:

$$k\ (\text{pulses}) = f\ (\text{Hz}) \cdot t(s) \cdot x \cdot 10^{-6}$$

For instance, if the measuring apparatus indicates a spread of 128 ppm and the inhibition is effected at the output of a divider furnishing a frequency of 8192 Hz and this every 60 seconds, the number k will be: $8192 \cdot 60 \cdot 128 \cdot 10^{-6} = 63$. Since this number k generally appears in binary form, one may calculate the number of bits necessary, which is:

$$\text{number of bits} = \log_2 k.$$

For a k of 63, the number of bits is 6 which indicates also the number of divide by 2 stages which will be affected by the correction.

It is interesting also to calculate the resolution which may be attained by the system, that is to say, the smallest discernible frequency spread in ppm, which is obtained when k=1. One thus has:

$$x\ (\text{ppm}) = \frac{1}{f(\text{Hz}) \cdot t(s)}$$

If one assumes the values cited above as example, it will be found $$\frac{1}{8192 \cdot 60} = 2.03\ \text{ppm}$$

With such a resolution and taking into account the fact that there are 86,400 seconds in a day, one may attain a precision of $86{,}400 \cdot 2.03 \cdot 10^{-6} = 0.17$ seconds per day or about 5 seconds per month. The table hereunder gives several of the possible practical combinations:

| Periodicity (s) | Correction at f (Hz) | Resolution (ppm) | Range of correction (ppm) | Number of bits | k (pulses) |
|---|---|---|---|---|---|
| 60 | 8192 | 2.03 | 128 | 6 | 63 |
| 30 | 8192 | 4.07 | 256 | 6 | 63 |
| 20 | 8192 | 6.10 | 385 | 6 | 63 |
| 20 | 8192 | 6.10 | 92 | 4 | 15 |
| 60 | 2048 | 8.14 | 122 | 4 | 15 |
| 60 | 4096 | 4.07 | 126 | 5 | 31 |

Returning now to FIG. 1, it will be seen that the apparatus 10 is equipped to measure the frequency spread in ppm or in k corresponding pulses and that it retains this value (in the figure and in the example k=21, reference 13). Thus it is a matter of programming the nonvolatile memory of the watch, such memory being contained in circuit 5, by the value retained by apparatus 10. To this effect and in accordance with the invention, the programming arrangement includes first means 14 controlled by the end of a driving pulse produced by the motor of the watch so as to introduce into certain predetermined stages of the watch divider a binary state corresponding to the number k of pulses measured by the apparatus 10 and second means 5 for blocking the contents of said stages as soon as the binary state in question is attained, then recording said contents in the non-volatile memory. This programming phase may be followed by a checking phase in a fast mode which permits one to determine that the memory has been properly programmed by the desired binary value. Finally, the timepiece is removed from its stand, then provided with a battery. From this moment the watch operates normally and the inhibition is executed with the periodicity which has been chosen.

The three phases which have just been mentioned are now to be explained in detail in referring to the figures which accompany the description.

1. Programming Phase

Figure 2:
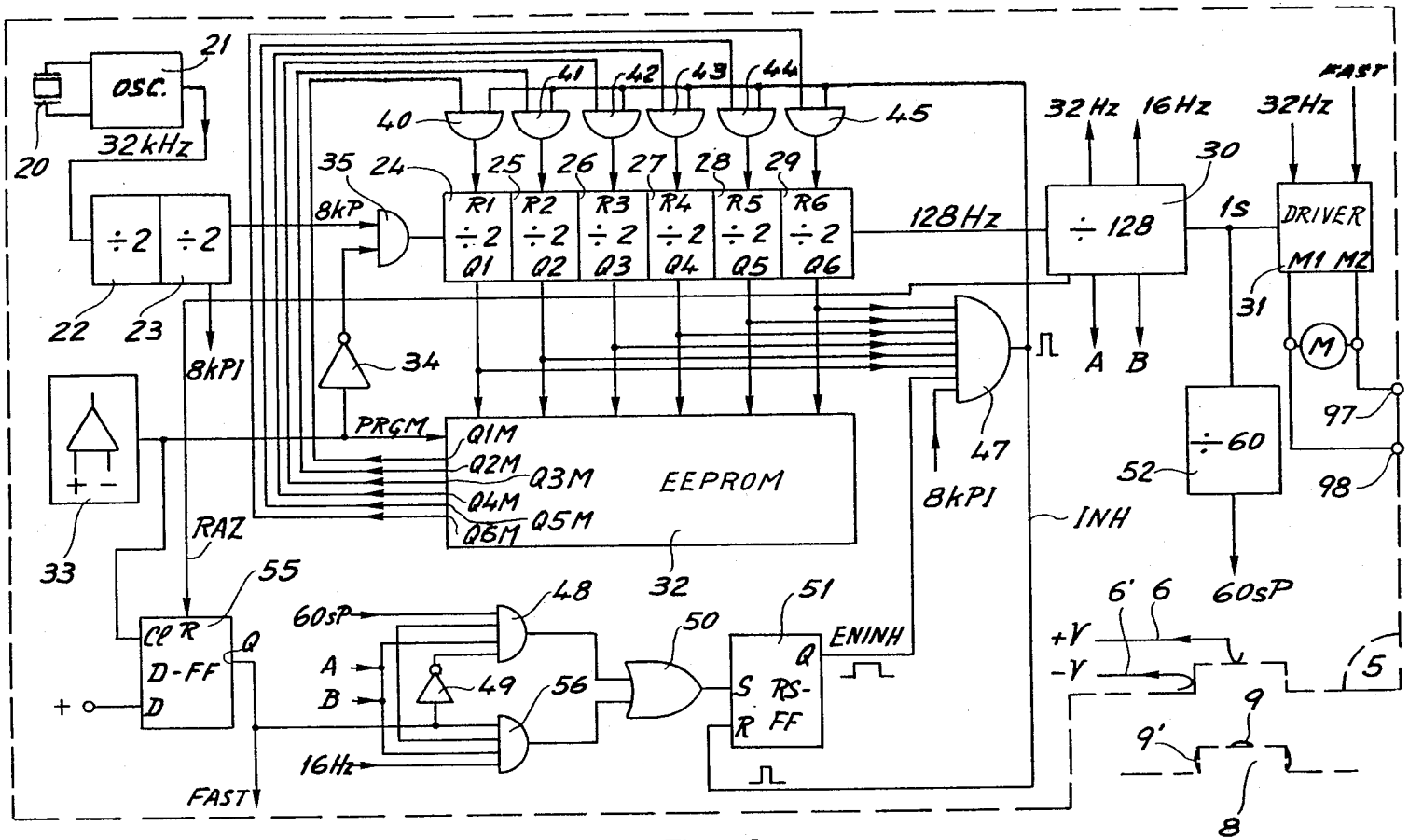
FIG. 2 is a detailed schematic drawing of the electronic circuit contained within the timepiece.

FIG. 2 is a detailed schematic of the electronic circuit contained within the watch, i.e. circuit 5 as shown in outline on FIG. 1. There will be found a quartz 20 controlling an oscillator 21 providing a frequency of 32,768 Hz. This frequency is divided by two several times. A first time division is by two stages 22 and 23 at the output of which will be found a signal of 8192 Hz reference 8 kP, a second time by the six stages 24 to 29 which furnish a signal at 128 Hz and a third time by a stage 30 including seven divide by two stages resulting in a final frequency of 1 Hz. The frequency of 1 Hz directs a driver circuit 31 to drive the stepping motor M which thus progresses one step per second. Outputs Q1 to Q6 of each of stages 24 to 29 are connected to corresponding recording inputs of a non-volatile electrically alterable memory 32 of 6 bits. All the elements of circuit 5 are energized by the voltage +V/−V coming from the external circuit 14 coupled to connector 8.

Memory 32 is well known from the state of the art. A detailed description thereof will be found for instance in the work entitled "Jahrbuch der deutschen Gesellschaft für Chronometrie", volume 33, 1982, pages 47 to 55, under the title: "Mémoires non volatiles EEPROM autonomes, application au réglage digital d'une montre à quartz". Here it suffices to recall that this type of memory may be programmed by data presented to its inputs during a certain period (about 250 ms) by raising its energizing voltage at the same time as is applied at its input PRGM a signal enabling the recording. The energizing voltage necessary for the recording is here on the order of 6 V. It is to be noted that the memory is provided with internal amplifiers which increase this voltage to a value greater than 25 V.

The enabling signal is itself provided by a voltage detector 33 of which the output is at 0 if the applied voltage is less than a certain threshold and at 1 if this voltage is greater than such threshold. The detector 33 may be a comparator, for instance an operational circuit. In the arrangement described here, the threshold is fixed at 3.5 V, which causes the detector to provide a signal 0 when the energization voltage is at low level (for instance 1.5 V) and a signal 1 when this voltage is at high level (for instance 6 V).

FIG. 2 likewise shows that the output signal PRGM from detector 33 is coupled via an inverter 34 to a first input of an AND-gate 35, the second input of this gate receiving pulses at 8 kHz from the divider 23. The output of AND-gate 35 is coupled to the input of the divider chain 24 to 29. Thus, in this arrangement, when the signal PRGM is present, gate 35 is blocked (signal 0 due to the inverter 34) and the pulses at 8 kHz no longer arrive at the input of the chain 24 to 29 which is thus blocked in the binary state which it exhibited at the moment of arrival of the signal PRGM.

Figure 3:
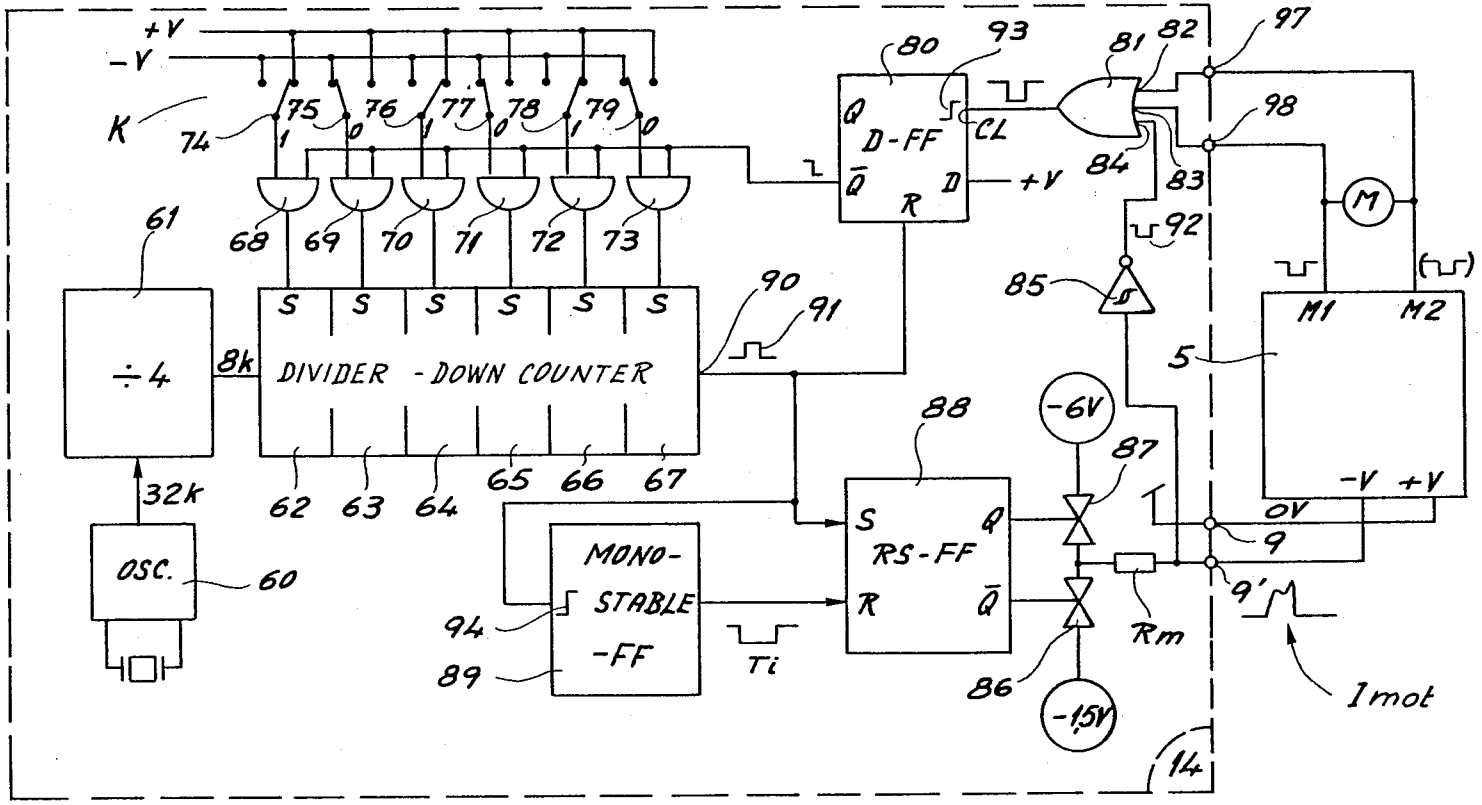
FIG. 3 is a detailed schematic diagram of the circuit external to the timepiece and which is employed in particular for programming the non-volatile memory.

FIG. 3 is a detailed schematic of the electronic circuit contained in the measuring apparatus outside the watch, i.e. circuit 14 shown in outline on FIG. 1. This circuit is equipped with a quartz time base 60 which furnishes a frequency coarsely adjusted to the frequency of the watch oscillator, here 32 kHz. The signal at 32 kHz is applied to a first divider by 4 referenced 61 and which furnishes a signal at 8 kHz. The signal at 8 kHz in turn is applied to a divider-counter or memory of six stages 62 to 67 of the same binary weight as the six stage divider 24 to 29 contained in the watch circuit. Each stage of the divider-counter possesses an input S (set) by which may be introduced a binary value provided by a corresponding AND-gate 68 to 73. The first input of each of the AND-gates is coupled to a respective switch 74 to 79 the switching terminals of which are respectively coupled to the + and to the − terminals of a DC energy source V. The position of each of these switches is representative of the number k, itself representative of the frequency difference between the frequency of the watch oscillator and a standard frequency, this difference being measured by the apparatus 10 of FIG. 1 as has been explained hereinabove. The second inputs of the AND-gates 68 to 73 are connected together and receive an output signal $\overline{Q}$ from a D flip-flop 80 of which the input D is connected to the + terminal of the DC source V. The clock input CL of the flip-flop 80 receives the output signal of an OR-gate 81 itself provided with three inputs 82, 83 and 84. The internal circuit 5 of the watch is energized by the terminals 9 and 9' either by a first energy source at 1.5 V via a switch 86 or by a second energy source at 6 V via a switch 87. A resistor Rm is placed in series with this energization arrangement. Thus the input 84 of the OR-gate 81 receives via a trigger inverter 85 a signal 92 representative of the current Imot in the winding of the motor when the latter is energized.

FIG. 3 further shows that the output 90 of the divider-counter 62–67 is coupled at the same time to the input R of D flip-flop 80, to the input of a monostable device 89 and to the input S of an RS flip-flop 88. The output of the monostable device 89 is coupled to the input R of the RS flip-flop 88 of which the output $\overline{Q}$ controls the switch 86 and of which the output Q controls the switch 87. Flip-flop 88 thus plays the role of a switch permitting energization of the circuit 5 of the watch either by a low level voltage (1.5 V) or by a high level voltage (6 V) via the switch 87.

Figure 4:
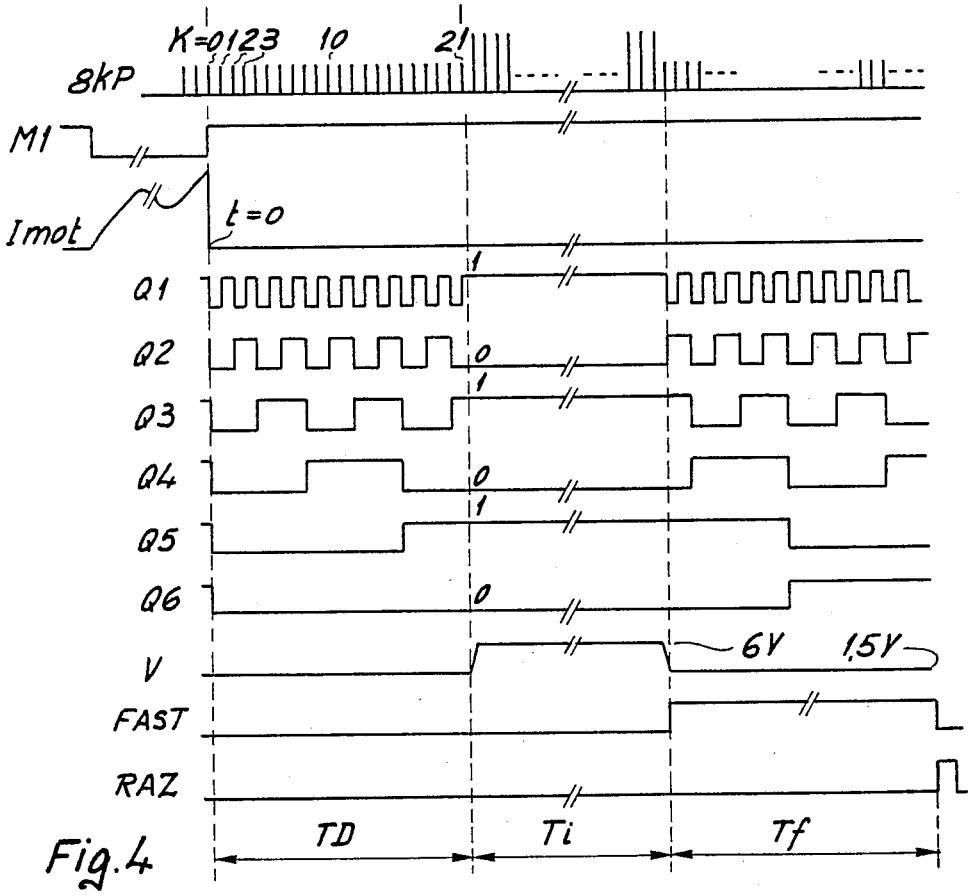
FIG. 4 is a diagram explaining the operation of the programming phase of the memory.

With reference to FIGS. 2 and 3 which have just been described and of the diagram of FIG. 4, there will now be explained how the programming phase of the non-volatile memory is carried out.

As has already been mentioned, apparatus 10 measures the frequency spread existing between the frequency of the watch oscillator and the standard frequency. This spread is expressed by a number k which is shown in binary form. Let such number be 21 written as 101010 in six-bit binary notion. This binary value is present in circuit 14 by virtue of switches 74 to 79 positioned as shown on FIG. 3.

When the watch 1 is plugged into its stand 7 (FIG. 1), circuit 5 of the watch is energized by an external voltage of 1.5 V supposing switch 86 of circuit 14 to be closed. From this instant, oscillator 21 starts up as well as the divider chain 22 to 30 which is coupled thereto. A driving pulse M1 appears at the output of the driver 31 (FIG. 4). To this driving pulse corresponds naturally a current Imot circulating in the winding of the motor M. This current exhibits an abrupt ending which corresponds to the end of the pulse M1. By definition the end of the driving pulse corresponds to the reset to zero of all the dividers 24 to 29 this being indicated on FIG. 4 at the time t=0 for all the dividers whose states are shown from Q1 to Q6. Parallel thereto the driving pulse 92 already inverted and reformed by trigger 85 of FIG. 3 passes through OR-gate 81. Its leading edge causes the output Q of the flip-flop 80 to pass to 1. In this manner the binary number 21=101010 present at the inputs of AND-gates 68 to 73 passes through said gates and is recorded in the counters 62 to 67 by their respective S inputs. Then the trailing edge 93 of pulse 92 causes the output $\overline{Q}$ of flip-flop 80 to pass to zero. From this moment which corresponds to the beginning of a period TD, the pulses 8 kHz coming from divider 61 modify the contents of the counters until the latter attain the binary value present at their inputs S. When this value is attained, the last counter 67 emits a carry pulse 91 at its output 90, this pulse appearing at the end of the period TD.

Returning now to FIGS. 2 and 4, it will be understood that the dividers 24 to 29 from the time t=0 which corresponds to the beginning of the period TD defined hereinabove are energized with pulses at 8 kHz coming from divider 23, since the AND-gate 35 is enabled, the signal PRGM being at zero. The state of dividers 24 to 29 will thus be modified to the point that their outputs Q1 to Q6 bear the binary value 101010 introduced into the 6 bit counter circuit 14 of FIG. 3. Thus, it is determined that the two circuits 5 and 14 function independently from one another but in parallel and in synchronism since the natural frequencies of their respective oscillators 21 and 60 have approximately the same frequency, the beginning of the process taking place for the two circuits at the same time t=0 which is that of the end of the driving pulse.

Thus at the end of the period TD, the binary state introduced into dividers 24–29 (Q1 to Q6) of circuit 5 corresponds to the emission of pulse 91 from the last counter 67 of circuit 14. It is now a matter of blocking the contents of dividers 24 to 29 which correspond to the binary number to be introduced into the non-volatile memory 32. To achieve this, pulse 91 is present at the input S of the RS flip-flop 88. At this instant its output $\overline{Q}$ passes to zero and its output Q goes to 1, this having as effect to energize the circuit 5 of the watch by a high level voltage (6 V) via switch 87 which is actuated. This high level voltage effects a 1 signal at the output of the voltage detector 33 (PRGM), thus blocking the AND-gate 35 via the inverter 34. The pulses at 8 kHz no longer arrive at dividers 24 to 29, the state of which is maintained at the binary value to be introduced into the memory.

The non-volatile memory 32 is then energized by a high level voltage and is thus enabled to accept the recording of the binary value present at the outputs Q1 to Q6 of the dividers 24 to 29. It has been said hereinabove that this recording requires a certain time which may be estimated at about 250 ms. The duration of this recording period Ti is determined by the monostable device 89 contained in the external circuit 14 and which is controlled by the rising edge 94 of pulse 91. Monostable flip-flop 89 begins thus its counting time Ti at the same time that the high level voltage is applied to memory 32. The end of period Ti resets RS flip-flop 88 to zero so as to open switch 87 and to close switch 86. From this moment circuit 5 of the watch is once again energized by the low level voltage of 1.5 V and the programming phase is complete (signal PRGM at zero).

The programming phase which has just been described hereinabove takes as reference the current flow brought about by the driving pulse causing the motor to advance through a step. For this, only the terminals of the battery are necessary. If one were to have access to terminals M1 and M2 of the motor, one could use the same arrangement as is shown in FIG. 3. In this case the motor terminals would be connected to the supplementary inputs 97 and 98 of circuit 14, these terminals being respectively coupled to inputs 82 and 83 of the OR-circuit 81, the operation of the entire arrangement remaining exactly the same.

This programming arrangement for the non-volatile memory which has just been described in detail forms the principal objective of this invention. It has been seen that the internal circuit of the watch enabling this programming requires only a single element in addition to the standard elements present for an inhibition system: the voltage level detector 33. Here the access limited to the battery terminals suffices for programming the memory and this at the price of an internal circuit the complexity of which is reduced to the minimum.

2. Execution of the inhibition phase

When the energization cell is re-installed in the watch receptacle, the watch operates normally with the inhibition which has been imposed thereon by the binary number recorded in the memory and this with a periodicity which has been discussed hereinabove. The manner in which the inhibition is brought about is known to the state of the art and thus does not form part of the present invention. It is however thought useful to describe it here in order to present a description as complete as possible.

If one refers once again to FIG. 2, one may enumerate the elements contained in the watch circuit which are necessary to the periodic bringing about of the inhibition. These are: the two input AND-gates 40 to 45, the AND-gate 47 with eight inputs, the AND-gate 48 with four inputs the inverter 49, the OR-gate 50, the RS flip-flop 51 and the divide by 60 circuit 52. All these elements are combined among themselves and with the elements already described as is shown by the schematic drawing of FIG. 2.

In order to give a concrete example, here there will be assumed a periodicity of 60 seconds, a number of bits equal to 6 and a correction realized from 8192 Hz, this corresponding to the combination given in the first line of the table shown hereinabove. It will be likewise supposed that the binary number recorded in the memory is 101010 (k=21).

Figure 5:
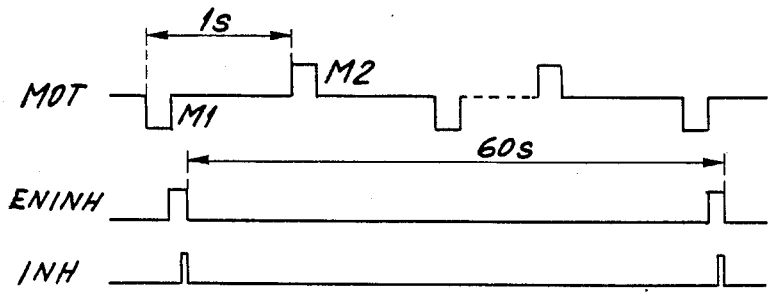
FIG. 5 is a diagram showing the normal operation of the timepiece following programming.

The diagram of FIG. 5 shows on its first line the alternating driving pulses M1 and M2 emitted every second. Line 2 shows an inhibition enabling signal (ENINH) set off every 60 seconds by a driving pulse M1. Line 3 represents the actual inhibition signal which is created during the presence of signal ENINH. Reference will now be made to the schematic of FIG. 2 and to the diagram of FIG. 6, this diagram constituting an increase in the time scale of what happens during and following the application of the signal ENINH of FIG. 5.

Dividers 24 to 29 are fed through AND-gate 35 which is enabled for the 8 kHz pulses designated by 8 kP and furnished by the divider 23. For requirements which will appear further on, divider 23 likewise provides pulses at 8 kHz designated by 8 kPI which are always interspersed between the pulses 8 kP. The signal of 1 s which appears at the output of divider 30 is applied to the input of the divide by 60 circuit 52. The output of this divider produces a pulse designated by 60 sP every 60 seconds which is applied to the input of the AND-gate 48. If the output of the inverter 49 is at 1 as well as lines A and B, the gate 48 allows the pulse 60 sP to pass and via the OR-circuit 50, causes the RS flip-flop 51 to change states, the output Q going to 1. The signals from lines A and B are produced by the divider 30 and are decoding signals determining the moment when the signal ENINH must be activated with respect to the driving pulse.

It has been seen hereinabove that at the end of a driving pulse M1 (t=0) and which corresponds to a pulse 8 kP, all the dividers 24 to 29 go to zero. At this instant appears signal ENINH at the same time as the signal of 128 Hz designated by 128 HP, but only once every 60 seconds. This signal is applied to an input of the AND-gate 47 and enables this gate when all the other inputs are at 1. The upper inputs of gate 47 are connected to the outputs Q1 to Q6 of the dividers 24 to 29 and all go to 1 just before arrival of the next pulse 128 HP shown in dotted lines on FIG. 6. At the same moment, there is emitted an interspersed pulse 8 kPI and the AND-gate 47 is enabled so as to produce the inhibit pulse INH.

Figure 6:
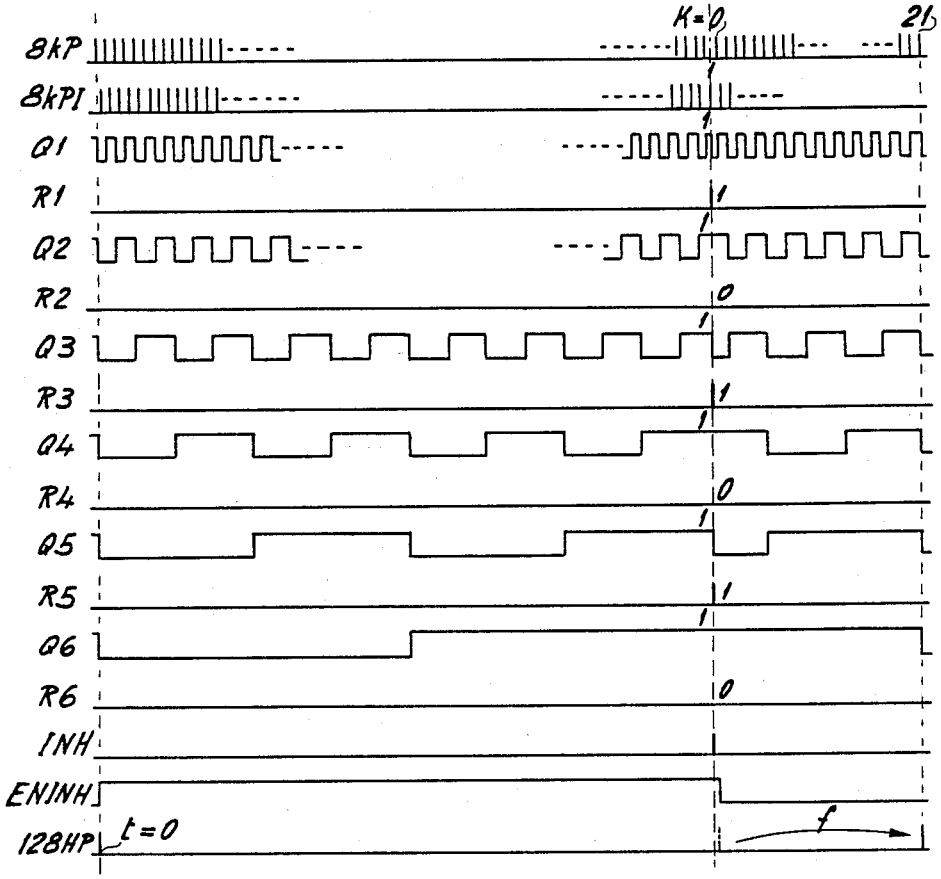
FIG. 6 is a diagram explaining in greater detail the operation of frequency adjustment summarily shown in FIG. 5.

The non-volatile memory exhibits at its outputs Q1M to Q6M the binary value which has there been programmed according to the procedure indicated hereinabove. This value is carried to the first inputs of the AND-circuits 40 to 45. At the instant the pulse INH appears on the second inputs of the same gates connected together, the binary value chosen to be 101010 is carried over to the inputs R1 to R6 of the dividers 24 to 29 and modifies the contents of said dividers as indicated on the diagram of FIG. 6. It will be noted in particular that the presence of 1 on the inputs R1, R3 and R5 causes the outputs of the corresponding dividers Q1, Q3 and Q5 to switch over while the presence of 0 on the inputs R2, R4 and R6 retains the outputs of the corresponding dividers Q2, Q4 and Q6 at their high level value. Thus the pulse 128 HP indicated by dots and which would be apparent if the inhibition had not taken place, does not appear and is delayed in the sense of the arrow f. As is shown by the diagram of FIG. 6, it will require 21 pulses 8 kP in order that the outputs Q1 to Q6 of dividers 24 to 29 are all brought back to zero and pulse 128 HP appears. This number k=21 represents the difference in frequency between the oscillator frequency of the watch and the standard frequency and is written 101010 in binary digits.

Finally, it will be noted that the inhbit pulse INH is employed to reset the RS flip-flop 51 to zero, this terminating the signal ENINH.

3. Checking phase in the fast mode

As has already been mentioned, the programming phase may be followed by a checking phase in fast mode to check whether the memory has been properly programmed to the desired binary value. This constitutes a secondary characteristic of the invention.

The fast mode employed for such checking is advantageous in view of the time saving which it brings about. Effectively, if checking were to take place during the normal operation of the watch, it would be necessary to wait 60 seconds (in the example chosen) to obtain a result and further one would not be certain of its exactitude since each inhibition period would be spaced out by 59 periods without inhibition.

Also, according to one embodiment of the invention, the arrangement comprises third means put into operation following application of the first and second means previously discussed in order to check that the division rate corresponds to the number k introduced into the memory. In the preferred embodiment of the invention, this third means includes a detector sensitive to the return of the voltage to its low level following the end of the period Ti in order to accelerate the motor during a predetermined period Tf to a speed v more rapid than that employed for time display and the adjustment of the rate of division to a speed v/2, which thus permits the alternation of intervals between driving pulses with and without adjustment in order to measure the frequency difference between the frequency of the watch oscillator and the standard frequency.

Figure 7:
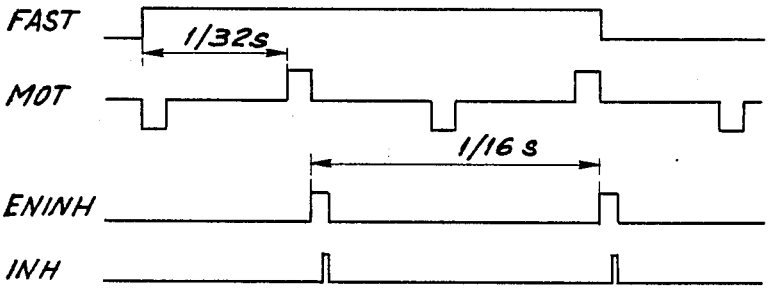
FIG. 7 is a diagram showing the operation in the rapid phase employed for the purpose of checking following the programming phase.

The diagram of FIG. 7 explains schematically the operation phase in fast mode. As soon as a signal referred to as fast mode (FAST) has been emitted, the motor receives pulses (MOT) at 32 Hz and the signal enabling the inhibition (ENINH), as well as the inhibition signal coupled thereto (INH), this being emitted at a speed half as fast, i.e. 16 Hz. There is thus an alternation between periods with and without inhibition, this permitting to check in a very short time (for example in 4 periods of 1/32 s) the relationship between the adjusted frequency and the non-adjusted frequency. The measurement may be obtained by means of the apparatus QUIS of which mention has been made hereinabove.

To effect this special mode of the invention, the internal circuit of watch 5 includes a D flip-flop 55 as well as an AND-gate 56 arranged as shown on FIG. 2. In this schematic the signals at 32 and at 16 Hz are taken from the divide by 128 circuit 30. The signal of 32 Hz is sent to the driver circuit 31 and energizes the motor at this speed when the signal FAST is present. The signal of 16 Hz is applied to an input of AND-gate 56, this gate playing exactly the same role as the AND-gate 48 for the 60 second signal 60 sP. When the signal FAST is present at the input of AND-gate 56, the AND-gate 48 is blocked by the inverter 49. Thus the signals ENINH and INH are created at the speed of 16 Hz and at a moment determined by the signals A and B as was the case for the normal execution phase of the inhibition.

The signal FAST begins when the energization voltage has been returned to its low level, at the end of the programming period Ti. Reference will be had back to FIGS. 2 and 4 to understand this operation. At the end of the period Ti, detector 33 emits a signal applied to the input CL of flip-flop 55, the output Q of which goes to the high potential of its D input. The signal FAST is thus present at the output Q of flip-flop 55 and enables the checking phase in the fast mode hereinabove described. This checking phase will last during a period Tf, for instance four times 1/32 of a second. The period Tf is terminated by a reset to zero signal RAZ applied to the input R of flip-flop 55. This signal may be obtained from the combination of signals present in the divide by 128 circuit 30. As soon as the signal FAST has been cancelled, the watch circuit will operate in normal mode.

Figure 8:
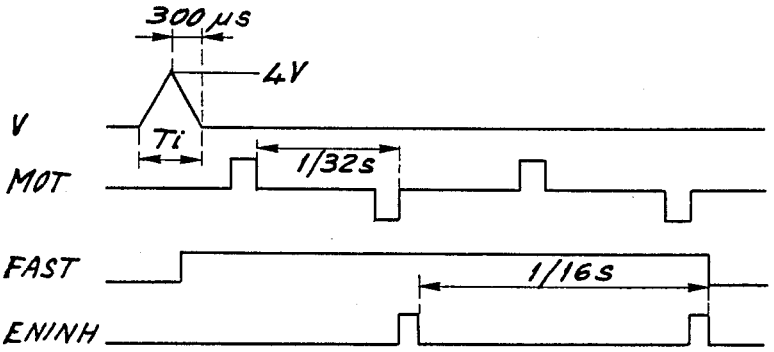
FIG. 8 is a diagram showing the operation in the rapid phase operated before the programming phase.

FIG. 8 shows how one may benefit from a circuit enabling the checking phase in fast mode for the needs of checking solely during repair of the watch for instance. For this one may considerably shorten the time constant of the monostable circuit 89 within the external circuit 14 in a manner such that the period Ti has a duration insufficient to set off the programming phase.

The falling edge of pulse Ti, which has been previously brought to a voltage higher than that to which responds the voltage detector 33 of the internal circuit 5, starts the checking phase in fast mode (FAST) immediately. The frequency spread is then measured by the apparatus QUIS of which mention has already been made. If this spread is correct, one may stop there. If such is not the case, one may set off a new programming phase. Here it has been found that a period Ti consisting of a rising time of 300 μs attaining 4 V, followed immediately by a descending time likewise of 300 μs, is perfectly suitable to the process of rapid checking alone.

What I claim is:

1. In a timepiece having an electrically alterable non-volatile memory, said timepiece including an oscillator, a multistage frequency divider the division rate of which is adjustable by alteration of a number k of pulses furnished by a stage thereof, the number k being representative of the frequency difference between the oscillator frequency and a standard frequency and appearing in a binary form recorded in the non-volatile memory in order to modify the contents of certain predetermined stages of the divider at regular intervals, a stepping motor receiving driving pulses from the divider to display time in an analog manner and a receptacle adapted to accommodate an energy cell, a programming arrangement for said non-volatile memory, said programming arrangement comprising;

first means controlled by the end of a driving pulse so as to introduce into said predetermined divider stages a binary state corresponding to said number k and second means for blocking the contents of said stages as soon as said binary state has been attained and thereafter recording said contents in said non-volatile memory, said first means being located externally to the timepiece and electrically coupled thereto by means of a connector plugged into the energy cell receptacle by its two terminals, said first means comprising an energy source for energizing the timepiece by a low level voltage or a high level voltage, a memory-counter into which may be introduced the number k, a time base the frequency of which is coarsely adjusted to the frequency of the timepiece oscillator, a detector for driving pulses the output edges of which coincide with the zero resetting of said predetermined divider stages, the output edge of one of said driving pulses defining the beginning of a period TD the duration of which is defined by the time necessary to introduce into said predetermined stages the binary state corresponding to the number k contained in the memory-counter, a switch for switching the energy source over to the high level voltage as soon as the end of said period TD is reached and a delay circuit for maintaining said voltage at its high level over a predetermined period Ti, and wherein the second means are incorporated into the timepiece and include a voltage level detector which when said voltage has attained a predetermined value situated between said low and high level voltages blocks the contents of said predetermined divider stages at the binary value they have attained at the end of said period TD and records said contents in said non-volatile memory during said predetermined period Ti.

2. A programming arrangement as set forth in claim 1 further comprising third means put into operation following operation of the first and second means so as to check that the rate of division corresponds to the number k representing the difference in frequency existing between the oscillator frequency and the standard frequency.

* * * * *